United States Patent [19]

Delaplaine

[11] 4,108,440

[45] Aug. 22, 1978

[54] GOLF PUTTING GAME

[76] Inventor: Delano Delaplaine, 2221 Park Rd., Charlotte, N.C. 28203

[21] Appl. No.: 818,421

[22] Filed: Jul. 25, 1977

[51] Int. Cl.[2] ..... A63B 69/36

[52] U.S. Cl. ..... 273/176 E; 273/180; 273/176 J; 273/176 H; 273/176 B; 273/87 C

[58] Field of Search ..... 273/87 R, 87 B, 87 C, 273/87.2, 87.4, 176 E, 176 G, 176 H, 176 J, 180, 176 B, 176 R, 176 F, 176 FA, 176 FB, 178 R, 178 B, 195 R, 34 B

[56] References Cited

U.S. PATENT DOCUMENTS

| | | | |
|---|---|---|---|
| 1,566,057 | 12/1925 | Wilkinson | 273/87 B |
| 1,870,536 | 8/1932 | Vaccaro | 273/176 G |
| 2,465,418 | 3/1949 | Baker | 273/180 |
| 2,750,192 | 6/1956 | Haslett | 273/87.2 |
| 2,995,372 | 8/1961 | Hines | 273/87 R |
| 3,399,899 | 9/1968 | Shepherd | 273/87 R X |
| 3,534,961 | 10/1970 | Tiley | 273/87 C |
| 3,735,988 | 5/1973 | Palmer et al. | 273/176 J X |
| 3,871,650 | 3/1975 | Casey | 273/176 H X |

*Primary Examiner*—George J. Marlo
*Attorney, Agent, or Firm*—Richards, Shefte & Pinckney

[57] ABSTRACT

A golf putting game is provided that employs a mat of foamed resilient material, such as polyurethane, which is of substantial thickness and size in plan having holes cut therethrough of putting cup size and located in the mat at selected positions that allow unobstructed lines of approach from teeing areas located along respective edges of the mat. Slices of the foamed material fitting the holes are disposed at the bottom thereof. The game is played with a conventional putter and golf ball, and teeing areas are arranged along edges of the mat corresponding to the respective holes. The holes and teeing areas are marked with appropriate indicia, and the mat is reversible to expose additional holes and teeing areas upon pressing the slices to the bottom of the holes upon each reversal. Additional foamed material slices are provided for selective location beneath the mat to modify the contour of its exposed surface.

5 Claims, 4 Drawing Figures

GOLF PUTTING GAME

BACKGROUND OF THE INVENTION

Various devices adapted for putting practice and games simulating golf play have heretofore been proposed, but the former have generally been intended for use on a rug or other available surface, while the latter have commonly been arranged for tabletop play and have generally been provided with other than conventional playing implements or have required an extensive layout for playing use.

The game of the present invention allows realistic putting practice in a variety of situations with a conventional putting and golf ball over a playing area of reasonable size, while being easily stored when not in use.

SUMMARY OF THE INVENTION

Generally described the golf putting game of the present invention comprises a mat of foamed resilient material, preferably polyurethane, which is of substantial thickness and size in plan. A convenient size has been formed to be a rectangular mat 75 inches long, 54 inches wide, and 2 inches thick. Holes of putting cup size are cut through the mat and slices of the foamed material fitting the holes are disposed at the bottom thereof bearing indicia of the hole number. These holes are located at selected positions in the mat that allow unobstructed lines of approach from teeing areas arranged along respective edges of the mat and bearing corresponding indicia. The mat is reversible to expose additionally marked holes and teeing areas upon pressing the slices to the bottom of the holes upon such reversal. Additional foamed material slices are provided for selective placing beneath the mat to modify the exposed mat surface contour whenever desired.

DETAILED DESCRIPTION OF THE INVENTION

Figure 1:
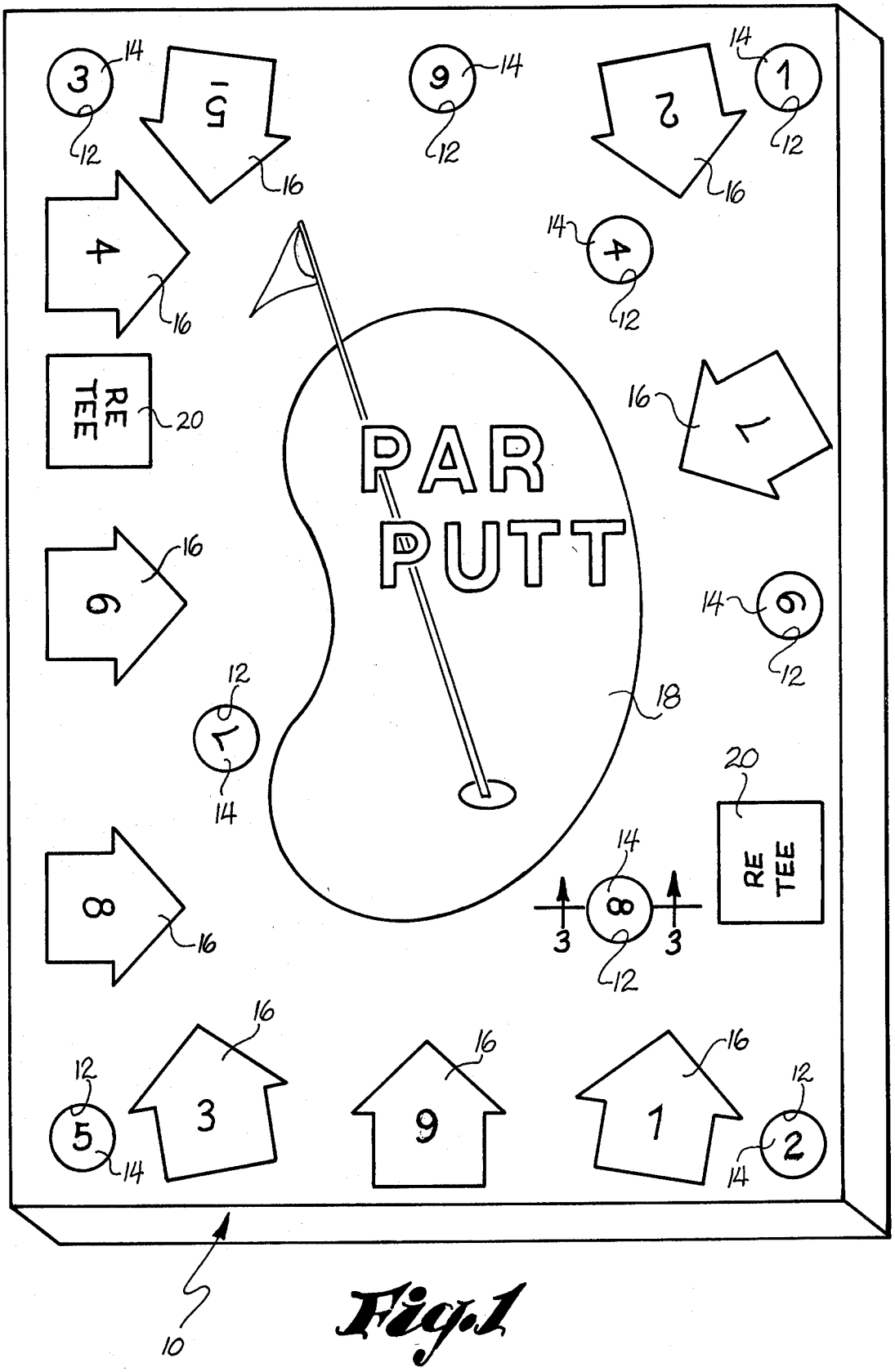
FIG. 1 is a plan view of one side of the mat used in the golf putting game of the present invention.
Figure 3:
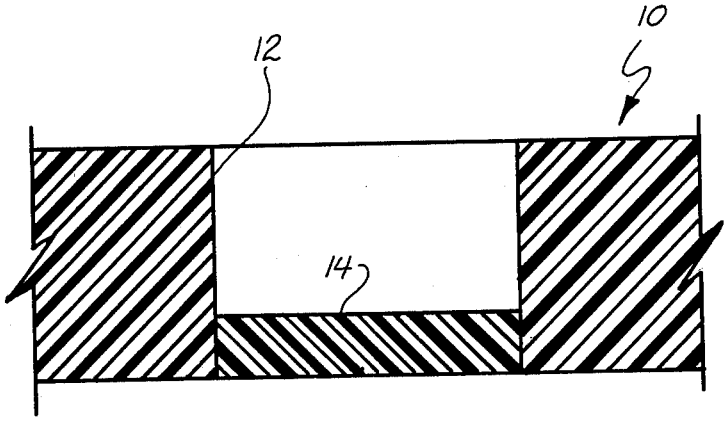
FIG. 3 is a fragmentary section detail taken substantially at the line 3-3 in FIG. 1.
Figure 4:
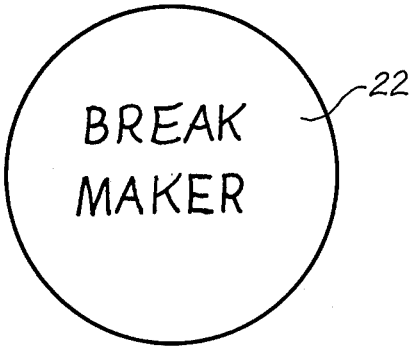
FIG. 4 is a plan view of one of the additional slices used optionally for contour modification of the mat.

The playing mat is represented at 10 in FIG. 1 with the top face exposed having holes 1 to 9 selectively positioned in the mat 10 and suitably marked as indicated at 12. The marking of the holes 12 is illustrated in FIG. 3 in which a slice 14 of foamed material from which the mat 10 is made is shown disposed at the bottom of the hole 12.

Figure 2:
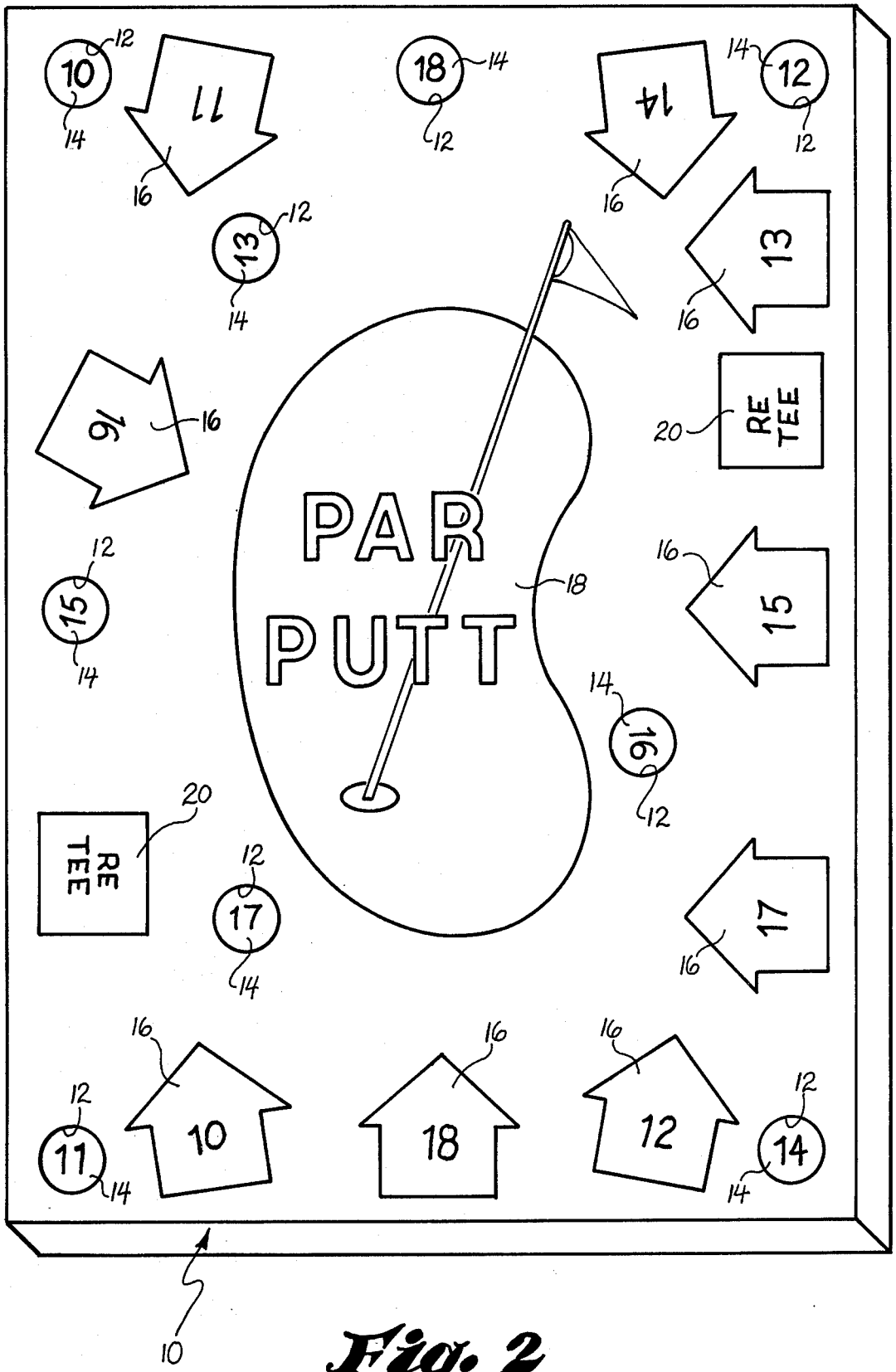
FIG. 2 is a corresponding plan view of the reverse side of the FIG. 1 mat.

The slices 14 can conveniently be formed from the material removed from the mat 10 when the holes 12 are cut so that they naturally fit the holes and can simply be pressed to the bottom thereof for use. Appropriate indicia are placed on one side of the slices 14 to designate the holes as 1 to 9, while on the opposite side the slices 14 bear indicia indicating holes 10 to 18 as seen in FIG. 2 which shows the reverse side of mat 10 exposed. Upon reversal of mat 10 it is only necessary to press the slices 14 to the bottom of holes 12 to continue play.

Each hole 12 is located to allow an unobstructed line of approach from a correspondingly marked teeing area 16 arranged along the respective edges of the mat 10. The indicia used for marking the teeing areas 16 and the slices 14 is done by printing so that a perfectly smooth mat surface is provided and the mat 10 may otherwise be decorated in the same way as at 18.

The game is played by allowing a par of 2 for each hole, and as many persons may play as desired. To start the golf ball is placed in the teeing area 16 for the first hole 14 and a conventional putter is used to stroke the ball to that hole 14. If the ball rolls off the mat 10 or goes in another hole, a penalty stroke is assessed and the player is required to replay at a penalty area 20 of his choice designated "RE TEE" by further printed indicia and try again for hole 14 being played and so on until he holes out. Then the other players follow in turn and the lowest score on the first hole starts play on the next hole under the same rules and continues until all the holes on the exposed face of the mat 10 have been played, then the mat 10 can be reversed and as soon as the slices 14 are pressed to the bottom of the holes 12 the play can continue through the remaining holes.

An interesting feature of the game is the realistic manner in which the ball drops in the holes 12 cut in the mat 10 when a shot is made. To make the game harder an additional supply of foamed material slices 22 called "BREAK MAKERS" are provided which may be placed beneath the mat 10 to modify the contour of its exposed surface and cause the ball to break as it approaches a hole.

The shape of the mat 10 can be any shape desired although rectangular shape is most convenient because it will roll easily for storage into a sleeve or the like when not in use. The foamed material mat lends itself readily to being spread out on a floor or a porch or lawn or wherever play is desired.

The present invention has been described in detail above for purposes of illustration only and is not intended to be limited by this description or otherwise to exclude any variation or equivalent arrangement that would be apparent from or reasonably suggested by the foregoing disclosure to the skill of the art.

I claim:

1. A golf putting game comprising a mat of substantial thickness and size in plan formed of foamed resilient material, nine holes cut through said mat of putting cup size and located at selected positions in said mat that allow unobstructed lines of approach from locations along the respective edges of said mat, slices of said foamed material fitting said holes and disposed at the bottom thereof, said foamed material slices bearing indicia of 1 to 9 on one side and 10 to 18 on the other side, indicia markers located around the edges of said mat indicating regular teeing areas for holes 1 to 9 on one side of the mat and for holes 10 to 19 on the other mat side, two auxilarly indicia markers at respective mat edges indicating penalty teeing areas, said regular teeing areas being located for unobstructed approach to the correspondingly indicated hole, a selected one of said penalty teeing areas being located for such approach to the holes, and said mat being reversible to expose holes marked 1 to 9 or holes marked 10 to 18 upon pressing said slices to the bottom of said holes upon each reversal.

2. A golf putting game as defined in claim 1 wherein said mat is formed of polyurethane.

3. A golf putting game as defined in claim 1 wherein said mat is rectangular in plan.

4. A golf putting game as defined in claim 3 wherein said mat is 75 inches long, 54 inches wide, and 2 inches thick.

5. A golf putting game as defined in claim 1 wherein additional slices of said foamed material are provided for selective location beneath said mat to modify the contour of the exposed surface thereof.

* * * * *